US011633830B2

(12) United States Patent
Guzman et al.

(10) Patent No.: US 11,633,830 B2
(45) Date of Patent: Apr. 25, 2023

(54) CMP POLISHING PAD WITH UNIFORM WINDOW

(71) Applicant: Rohm and Haas Electronic Materials CMP Holdings, Inc., Newark, DE (US)

(72) Inventors: Mauricio E. Guzman, Bear, DE (US); Nestor A. Vasquez, Middletown, DE (US); Matthew R. Gadinski, Newark, DE (US); Michael E. Mills, Bear, DE (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 331 days.

(21) Appl. No.: 16/910,851

(22) Filed: Jun. 24, 2020

(65) Prior Publication Data

US 2021/0402556 A1 Dec. 30, 2021

(51) Int. Cl.
*B24B 37/20* (2012.01)
*B24B 37/04* (2012.01)

(52) U.S. Cl.
CPC ..... *B24B 37/205* (2013.01); *B24B 37/042* (2013.01)

(58) Field of Classification Search
None
See application file for complete search history.

(56) References Cited

U.S. PATENT DOCUMENTS

| | | | |
|---|---|---|---|
| 5,605,760 | A | 2/1997 | Roberts |
| 7,258,602 | B2 | 8/2007 | Shih et al. |
| 7,429,207 | B2 | 9/2008 | Swedek et al. |
| 7,621,798 | B1 | 11/2009 | Bennett et al. |
| 8,475,228 | B2 | 7/2013 | Benvegnu et al. |
| 9,475,168 | B2 | 10/2016 | Qian et al. |

FOREIGN PATENT DOCUMENTS

| | | |
|---|---|---|
| JP | 2006021290 | 1/2006 |
| KR | 2002008477 | 1/2002 |

*Primary Examiner* — Long Pham
(74) *Attorney, Agent, or Firm* — John J. Piskorski; Blake T. Biederman

(57) ABSTRACT

A polishing pad useful in chemical mechanical polishing comprising a polishing portion having a top polishing surface and comprising a polishing material an opening through the polishing pad, and a transparent window within the opening in the polishing pad, the transparent window being secured to the polishing pad and being transparent to at least one of magnetic and optical signals, the transparent window having a thickness and a top surface having a plurality of elements separated by interconnected recesses to provide a pattern in the top surface that includes recesses for improved deflection into a cavity in the polishing pad during polishing.

9 Claims, 7 Drawing Sheets

CMP POLISHING PAD WITH UNIFORM WINDOW

FIELD OF THE INVENTION

The present invention relates generally to the field of polishing pads for chemical mechanical polishing. In particular, the present invention is directed to a chemical mechanical polishing pad having a polishing structure useful for chemical mechanical polishing of magnetic, optical and semiconductor substrates, including front end of line (FEOL) or back end of line (BEOL) processing of memory and logic integrated circuits.

BACKGROUND

In the fabrication of integrated circuits and other electronic devices, multiple layers of conducting, semiconducting and dielectric materials are deposited onto and partially or selectively removed from a surface of a semiconductor wafer. Thin layers of conducting, semiconducting and dielectric materials may be deposited using several deposition techniques. Common deposition techniques in modern wafer processing include physical vapor deposition (PVD), also known as sputtering, chemical vapor deposition (CVD), plasma-enhanced chemical vapor deposition (PECVD) and electrochemical deposition (ECD), among others. Common removal techniques include wet and dry etching; isotropic and anisotropic etching, among others.

As layers of materials are sequentially deposited and removed, the topography (i.e. uppermost surface) of the wafer becomes non-uniform or non-planar. Because subsequent semiconductor processing (e.g., photolithography, metallization, etc.) requires the wafer to have a flat surface, the wafer needs to be planarized. Planarization is useful for removing undesired surface topography and surface defects, such as rough surfaces, agglomerated materials, crystal lattice damage, scratches and contaminated layers or materials. In addition, in damascene processes a material is deposited to fill recessed areas created by patterned etching of trenches and vias etc. but the filling step can be imprecise, and overfilling is preferable to underfilling of the recesses. Thus, material outside the recesses needs to be removed.

Chemical mechanical planarization, or chemical mechanical polishing (CMP), is a common technique used to planarize or polish workpieces such as semiconductor wafers and to remove excess material in damascene processes, front end of line (FEOL) processes or back end of line (BEOL) processes. In conventional CMP, a wafer carrier, or polishing head, is mounted on a carrier assembly. The polishing head holds the wafer and positions the wafer in contact with a polishing surface of a polishing pad that is mounted on a table or platen within a CMP apparatus. The carrier assembly provides a controllable pressure between the wafer and polishing pad. Simultaneously, a slurry or other polishing medium is dispensed onto the polishing pad and is drawn into the gap between the wafer and polishing layer. To effect polishing, the polishing pad and wafer typically rotate relative to one another. As the polishing pad rotates beneath the wafer, the wafer traverses a typically annular polishing track, or polishing region, wherein the wafer's surface directly confronts the polishing layer. The wafer surface is polished and made planar by chemical and mechanical action of the polishing surface and polishing medium (e.g., slurry) on the surface.

Precise control of various aspects (e.g. the thickness of layers) on the substrate being polished can be desirable.

Thus, various methods have been proposed to detect when polishing is completed to the desired level. Since polishing pads are often made of opaque materials a transparent window has been inserted in the polishing pad. This enables an optical detection system where a source directs electromagnetic radiation (e.g. light of desired wavelength) through the transparent window toward the substrate and a sensor detects the electromagnetic radiation (e.g. light) reflected from the wafer and passing back through the window. Various window designs have been proposed. See e.g. U.S. Pat. Nos. 7,258,602; 8,475,228; 7,429,207; 9,475,168; 7,621,798; and 5,605,760 and JP2006021290. A need remains for a pad design with a window that provides good signal for sensing while also managing problems (e.g. defects, window deflection, changing hydrodynamics, deflection, fluid transport, etc.) that can arise from inserting a window into a polishing pad.

SUMMARY OF THE INVENTION

Disclosed herein a polishing pad useful in chemical mechanical polishing of a semiconductor, optical or magnetic substrate comprising a polishing portion having a top polishing surface, a bottom layer for mounting to a platen and a polishing material, the top polishing surface including grooves; an opening through the polishing pad, and a transparent window within the opening in the polishing pad, the transparent window being flexible and having a thickness measured from a bottom of the transparent window to the top polishing surface of the transparent window and being secured to the polishing pad with the transparent window spaced from the platen to form a cavity and being transparent to at least one of magnetic and optical signals, the transparent window having a plurality of projecting elements at a perimeter of the transparent window and filling the center of the transparent window, the tops of the plurality of projecting elements representing the top polishing surface of the transparent window, the projecting elements having an initial height of at least thirty percent of the thickness of the transparent window, the projecting elements being coplanar with the top polishing surface separated by interconnected recesses that extend to a peripheral edge of the transparent window to provide a projecting element pattern in the top surface wherein a majority of the recesses have partial or complete misalignment with the grooves in the top polishing surface and the projecting element pattern allows bending about multiple axes with the transparent window bending into the cavity and at least two of the axes are non-parallel or with a center projecting element, the center projecting element surrounded by one or more recesses that bend downward into the cavity with the center projecting element having a width less than half a longest dimension of the transparent window for reducing contact pressure with the substrate during polishing.

By "uniform" regarding the window is meant that the pattern repeats across the top surface of the window and that the pattern is same or similar in both x and y directions, or that the pattern has point symmetry or substantial point symmetry. By substantial point symmetry is meant that there may be a offset from symmetry by a small amount—e.g. (1) the center point of the window may be offset from a center point that would provide point symmetry for the window by an amount less than 10%, less than 5%, less than 2% or less than 1% based on maximum window dimension (e.g. height, width, diameter) and/or (2) spacing between elements (e.g. recesses width) can vary up to 25%, up to 10%, up to 5%, and/or (3) dimensions of elements may be slightly non-uniform, e.g. feature dimension such as radius, length, or width may vary by up to 25%, up to 20%, up to 10%, up to 5%, up to 2% from one feature to another feature.

Also disclosed is a method of polishing using such a polishing pad.

DETAILED DESCRIPTION OF THE INVENTION

Figure 1A:
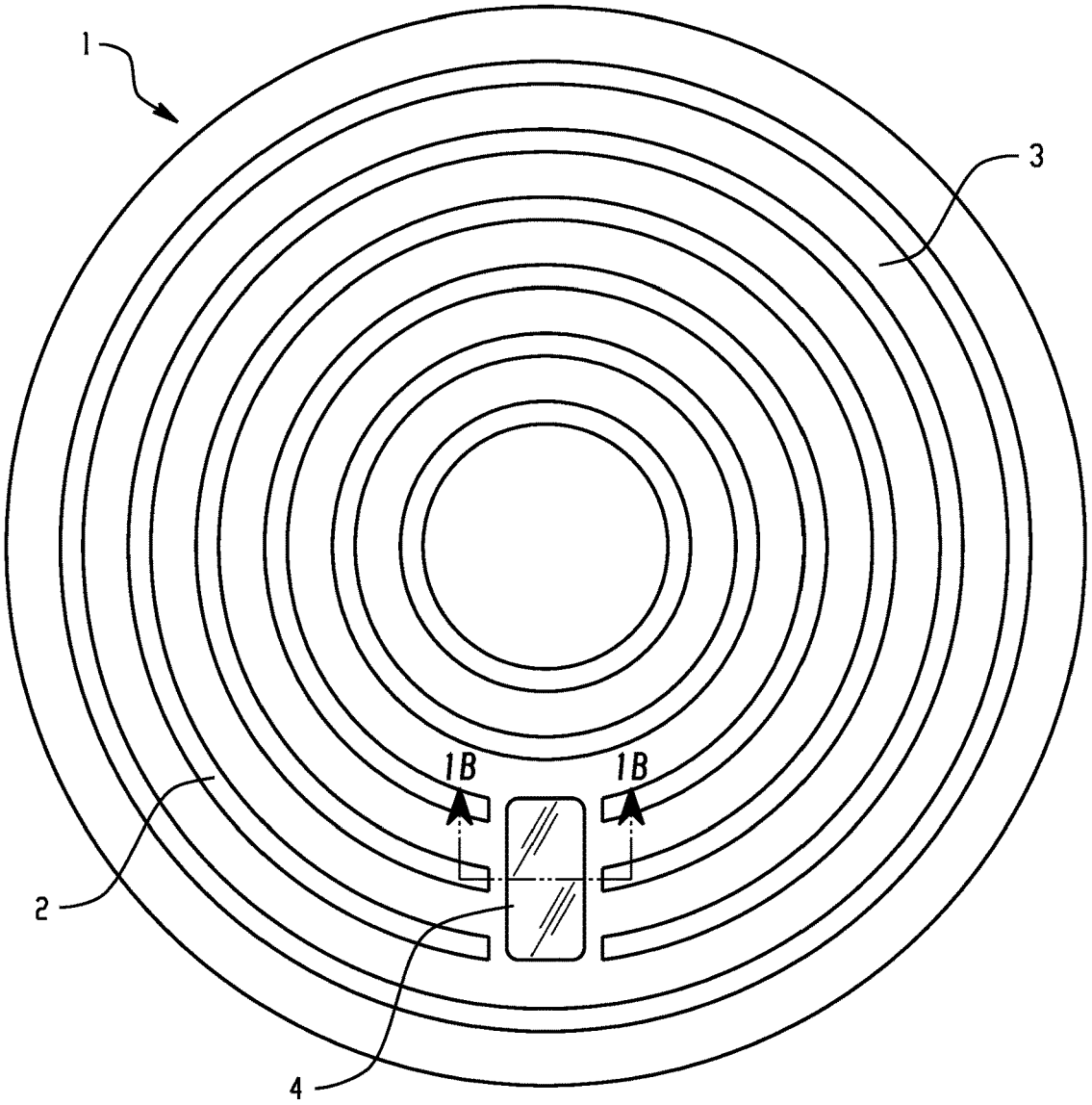
FIG. 1A is a top view of a portion of a prior art polishing pad with a planar window insert.

The transparent window as disclosed herein is useful for CMP polishing pads useful in chemical mechanical polishing of a semiconductor, optical or magnetic substrate. Before the invention, those skilled in the art believed that transparent windows should be stiff to avoid issues with the pad becoming convex or concave. Earlier solutions to these issues included attempts to render the transparent polyurethane materials creep resistant and designs to allow pressure relief. Applicants have discovered that projecting elements separated by a series of recesses can increase compliance of the window without sacrificing adequate signal strength for endpoint detection.

The polishing pad includes a polishing portion having a top polishing surface and a bottom layer for mounting a polishing material, such as a porous polyurethane polishing pad to a circular stainless steel platen. The top polishing surface includes grooves, such as circular, spiderweb, x-y Cartesian, spiral or other known groove patterns. A transparent window is secured within the opening in the polishing pad. The window can be cast in place then skived or cast and secured to the polishing pad with an adhesive or other known means for securing a polymeric window to a polymeric pad material.

The transparent window has a thickness measured from a bottom of the transparent window to the top polishing surface of the transparent window. The transparent window is being secured to the polishing pad with the transparent window spaced from the platen to form a cavity. The window is transparent to at least one of magnetic and optical signals. Usually, the window is transparent to light having a range of wavelengths useful for determining a polishing endpoint. The cavity allows downward deflection of the transparent window to reduce forces against the substrate The transparent window has a plurality of projecting elements at a perimeter of the transparent window and filling the center of the transparent window. The tops of the plurality of projecting elements represent the top polishing surface of the transparent window. The top polishing surface of the window is in alignment with the top polishing surface of the polishing pad. The projecting elements have an initial height of at least thirty percent of the thickness of the transparent window. For thicker windows, the projecting elements have an initial height of at least fifty percent of the thickness of the transparent window. This height represents the height from the bottom of recesses to the top surface of the projecting elements. The projecting elements are coplanar with the top polishing surface separated by interconnected recesses that extend to a peripheral edge of the transparent window. If there was a solid backing behind the window, the recesses would substantially increase pressure against the substrate. The recesses combine to provide a projecting element pattern in the top surface wherein a majority of the recesses have partial or complete misalignment with the grooves in the top polishing surface. Typically, at least eighty percent of the recesses have partial or complete misalignment with the grooves in the top polishing surface. In some instances, all the recesses have partial or complete misalignment with the grooves in the top polishing surface In a first embodiment, the projecting element pattern allows bending about multiple axes with the transparent window bending into the cavity and at least two of the axes are non-parallel. Examples of non-parallel bending include bending along the x-axis and bending upon the y-axis. Another example of non-parallel bending is the three bending axes that form with hexagonal close packed arrangement of the projecting elements. The bending along multiple axes facilitates reducing contact pressure with the substrate during polishing.

In a second embodiment, a center projecting element surrounded by one or more recesses bend downward into the cavity. To facilitate efficient bending, the center projecting element has a width less than half a longest dimension of the transparent window. This act to reduce contact pressure with the substrate during polishing. With more complex recess patterns, it is possible to bend along two or more non-parallel axes with a center portion that bends into the cavity.

Figure 1B:
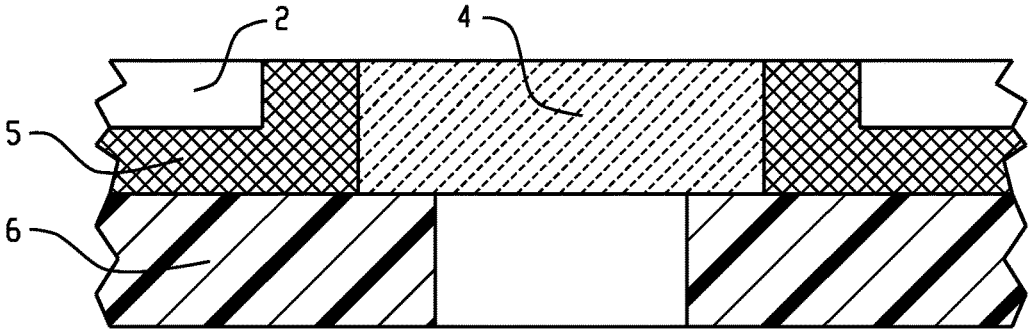
FIG. 1B is a cross section of FIG. 1A taken along plane 1B-1B.

FIGS. 1A and 1B show a prior art pad 1 with window 4. There can be grooves 2 in the planar surface 3 of the polishing portion 5. The polishing portion can be a separate layer on a subpad or base pad 6.

Figure 2:
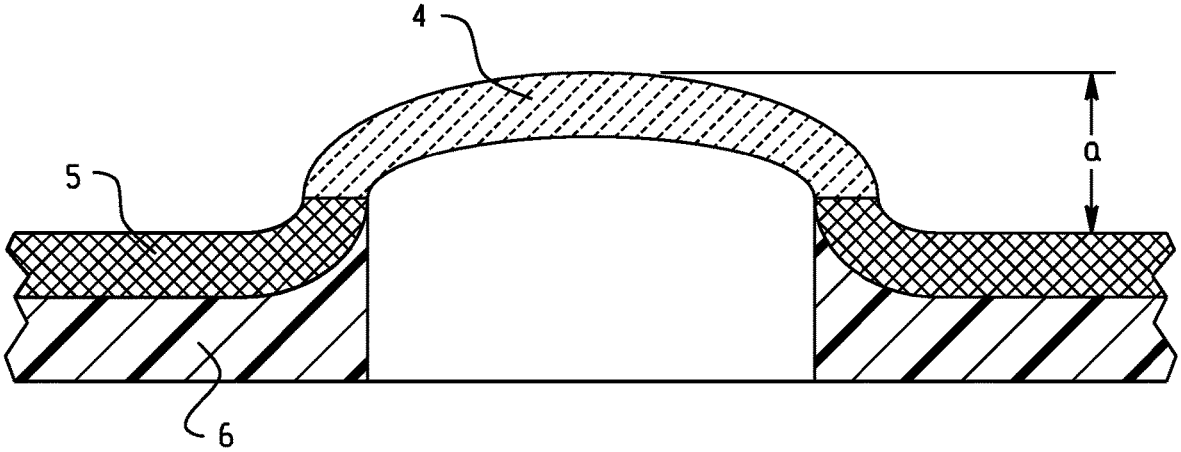
FIG. 2 is a cross section of a prior art polishing pad as in FIG. 1 illustrating non-uniform deformation of the pad under load.

The polishing pads disclosed herein can provide certain advantages. Specifically, the pads disclosed herein can diminish problems associated with deflection deformation associated with a window in a pad and problems associated with fluid management around the window. A problem of deflection can arise since the material of the window and the material polishing portion of the pad are different, (e.g. different modulus). The responses of these materials to the load placed on the pad during polishing can lead to non-uniform deflection. For example, a polishing pad may have a composite Young's modulus, E, for a base pad and polishing layer of around 0.15 to 0.2 GPa while an inert transparent window material may have a Young's modulus of around 0.9 to 1 GPa. For example, FIGS. 1A and 1B show a prior art pad 1 with a planar window 4, a polishing portion 5, and a sublayer 6. As shown in FIG. 2 (not to scale), showing deflection of simple planar window 4 under stress since the material of the polishing portion 5 of the pad is often more compliant, the window 4 may project above the surface of the adjacent polishing material 5 during polishing. This can lead to a gap illustrated by dimension (a) in the region adjacent to the window such that there is not good contact between the polishing material and the substrate being polished, and slurry and particles can become trapped producing scratches in the substrate. Gap "a" represents the height between the top of window 4 and polishing portion 5. During polishing, subpad 6 cushions away some of the gap a, but this gap can represent a serious issue during polishing. In addition, during conditioning of the pad (that can involve abrading the surface of the pad) the surface of the window may experience differential wear that can lead to drift of the signal due to variation in window thickness and/or premature failure of the pad due to window thinning and potential perforation of the window. In addition, windows that are planar with the surface of the polishing surface or windows that are recessed from the surface of the polishing surface each present problems of fluid management in that slurry and debris can collect in the window particularly at the outer periphery of the window. This slurry and debris build up can produce scratches and can interfere with the light transmission and resulting optical sensing of a polishing endpoint.

Previous proposals typically addressed only the issues of deflection or only issues of fluid management.

The pads as disclosed herein having a window with interconnected recesses that provide a uniform pattern can increase the compliance of the window without having to change the material of the window thereby reducing the contact pressure of the window. In addition, the recesses in the window of the pads as disclosed herein can facilitate fluid transfer and avoid build-up of slurry and polishing by-products in the window region and adjacent area that can cause scratching and interfere with the endpoint light signal.

Figure 3A:
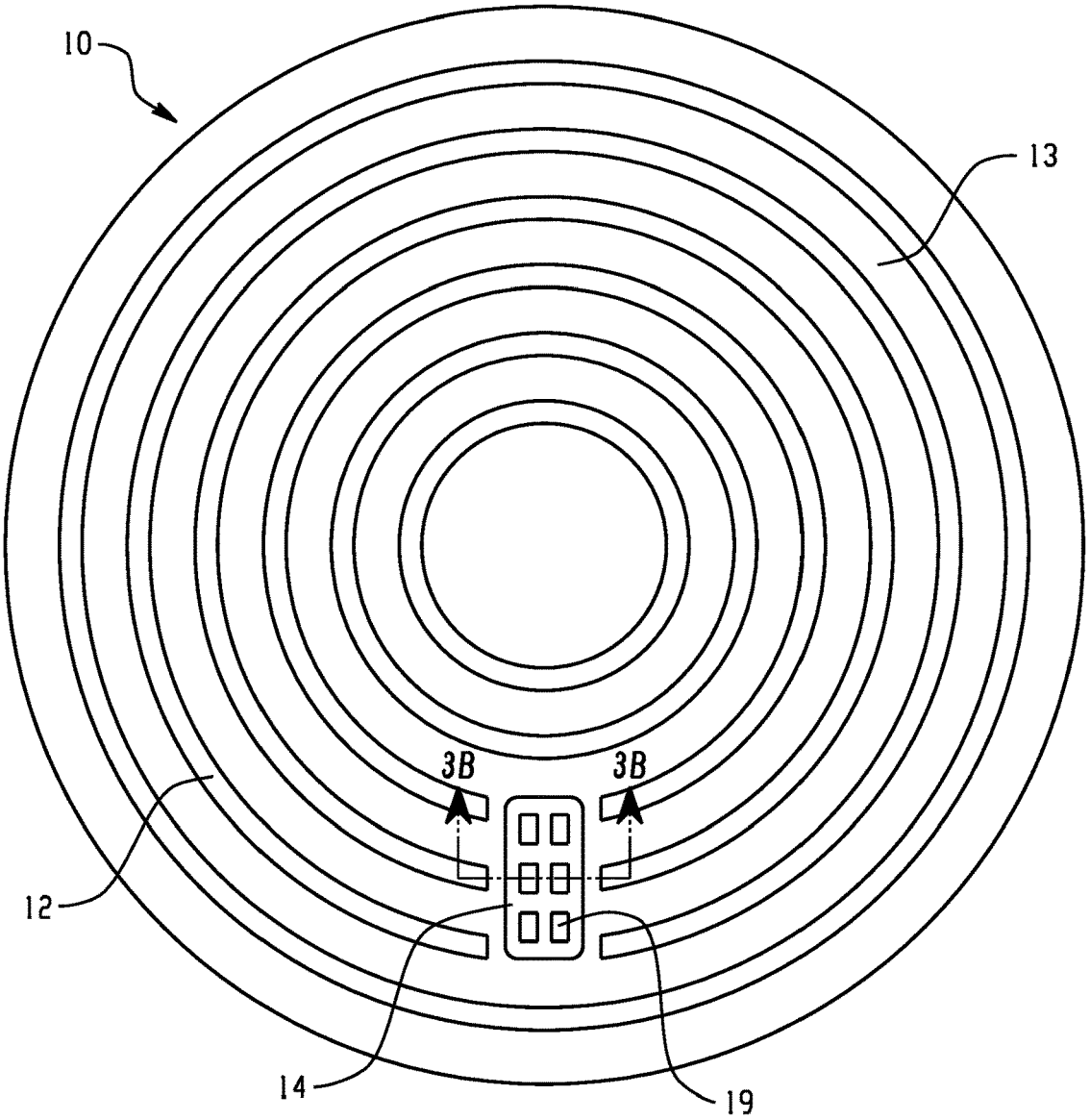
FIG. 3A is a top view of a polishing pad including a window with a uniform pattern of interconnected recesses.
Figure 3B:
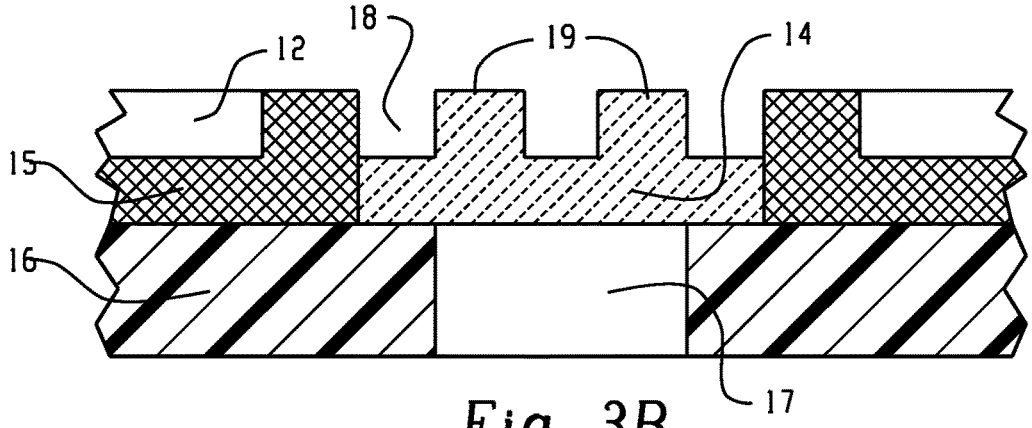
FIG. 3B is a cross section of the pad of 3A, taken along plane 3B-3B.

As shown in FIGS. 3A and 3B, the polishing pad 10 as disclosed herein has a polishing portion 15. The polishing portion 15 is a top portion and has a top polishing surface 13 having grooves 12 therein. FIG. 3 shows the grooves 12 ending before the edge of the window 14, however it is also contemplated that the grooves 12 could continue to the edge of the window 14. Advantageously, the grooves 12 extend to the window 14 to provide more consistent fluid flow on the polishing pad 14. Grooves on the pad can be aligned to recesses in the window. Alternatively, grooves on the pad can be not aligned or have partial alignment with recesses in the window. Typically, at least about eighty percent of the grooves 12 do not align with grooves on the polishing pad 10. The polishing pad 10 can also have as is shown in FIG. 3B a lower layer (that can be a base pad) 16. The window 14 is secured in a cavity 17 in the pad 10 enabling the signal used for endpoint detection to pass through the pad to the substrate and be reflected back. More importantly, however, the cavity 17 below the bottom of window 14 allows bending of window 14 to reduce contact stresses between the window 14 and a substrate, such as a semiconductor wafer during polishing. The window 14 has elements 19 separated by recesses 18 as shown in FIG. 3B that is a cross section of the window 14 from a to b. The recesses 18 increase the resulting local contact against substrates during polishing, but the bending of window 14 into cavity 17 during polishing reduces contact pressure during polishing significantly. The upper surface of the elements 19 can be coplanar with the top polishing surface 13 or can be slightly recessed. Since the polishing pad and substrate rotate during polishing, the x-axis can be parallel with the radius of the polishing pad, perpendicular to the radius of the polishing pad or have any angle between these angles. Typically, however, the x-axis is parallel to and aligned with a radius of the polishing pad.

Various examples of the windows that can be used in the pads disclosed herein are shown in FIGS. 4A, 4B, 5A, 5B, 6, 7, 8 and 9. The windows have recesses and elements that form a uniform pattern. For example, the recesses can be uniformly spaced and uniformly sized around the elements. The elements can be of uniform size and spacing. There can be uniform size and spacing in the x coordinate and in the y coordinate.

Figure 4A:
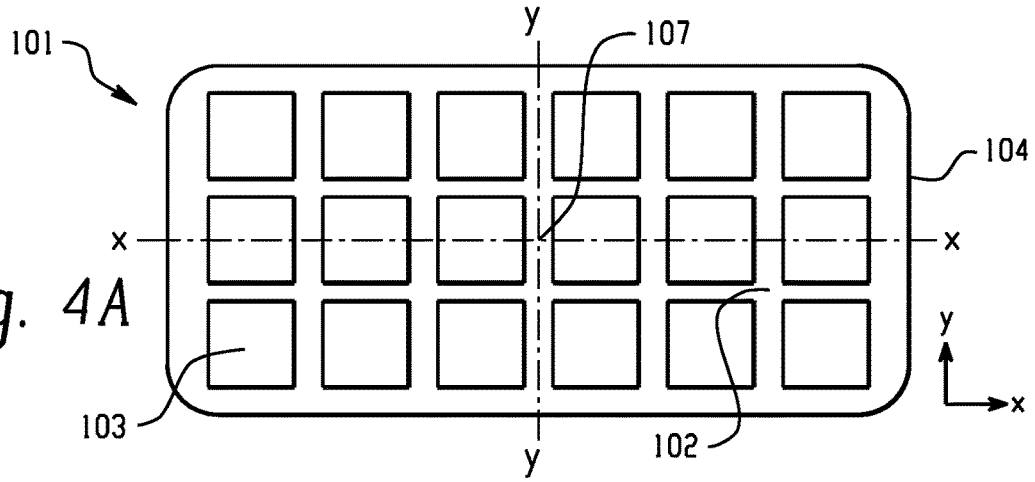
FIGS. 4A and 4B represent top and side views, respectively, of a rectangular window having elements separated by interconnected recesses.
Figure 4B:
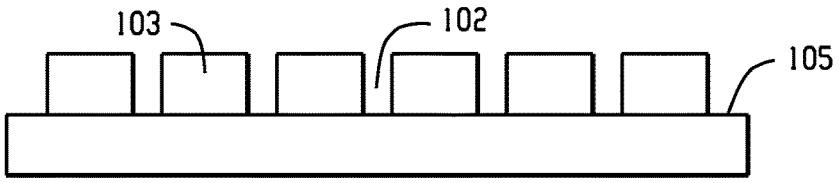
Figure 5A:
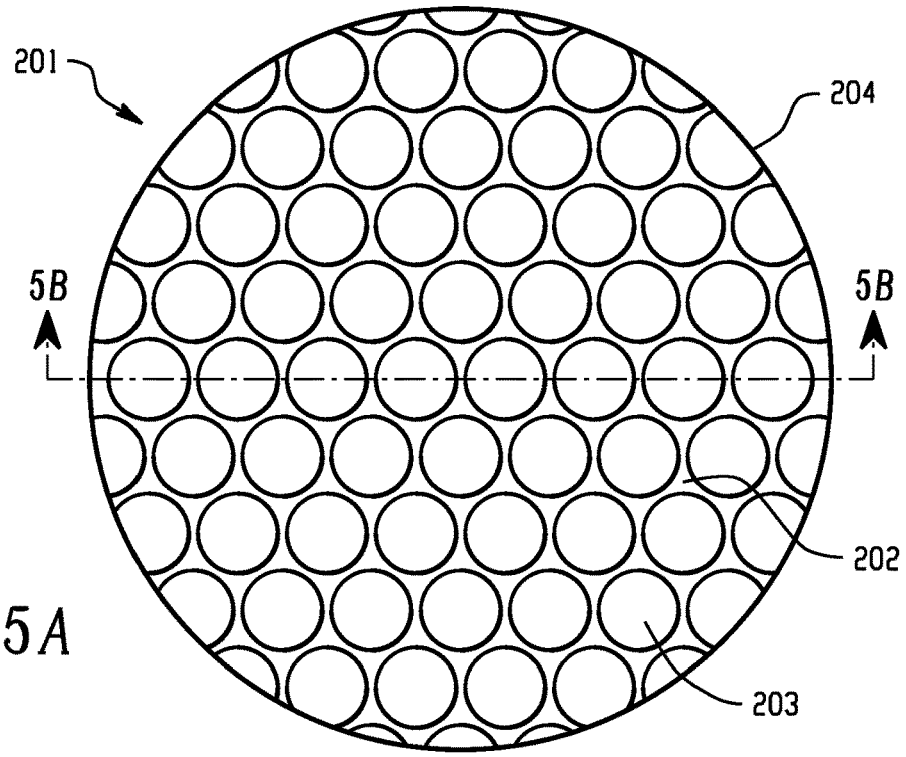
FIGS. 5A and 5B represent top view and side views, respectively, of a circular window having elements separated by interconnected recesses.
Figure 5B:
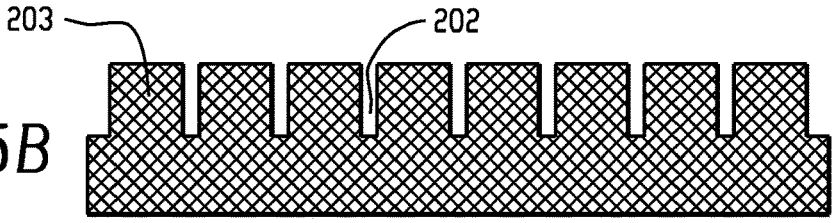

FIGS. 4A and 4B show a rectangular window 101 having an upper surface having an interconnected array of recesses 102. These recesses 102 have a width as measured between rectangular projections 103 and a depth as measured from top of rectangular projections 103 to the lower surface 105 in a location between recesses 102. This produces a regular and uniform array of rectangular projections (also referred to as projecting elements) 103 that can be a contacting surface of the window to the article to be polished. The upper surface of the projections 103 can be coplanar with the upper surface of the polishing pad. The fractional area of the projecting surfaces can be adjusted by increasing or decreasing the recess width and/or its pitch (i.e. center to center distance of recesses or center to center distance of elements). This allows for simple adjustment of the window transmittance to accommodate the spot size of the sensor that will project through light through the window. Stiffness can also be readily adjusted by varying the depth of the recess array 102. The width and the depth of the recesses can be the same throughout the window or it can vary provided that the variation is done in a uniform manner. FIGS. 4A and 4B show the use of a regular square array of recesses. However, one can use a variety of other recess array patterns and element shapes, including, but not limited to hexagonal array of recesses to yield circular, triangular, or hexagonal projection cross-sections, or combinations of differing pattern sizes or overlays of patterns, if the resulting recess array facilitates bending along at least two non-parallel axes. The recess array has point symmetry about center 107. For purposes of this specification, point symmetry represents all points of the projecting elements 103 and recesses 102 being in the same location after rotating 180 degrees about a vertical axis. In this example, all points in the x and y coordinates have point symmetry about center 107. These interconnected recesses facilitate bending along recesses parallel to x-axis x-x, along y-axis recess y-y and along recesses with axes parallel to axis y-y. FIGS. 3 to 9 all represent designs that have point symmetry about their x and y axes. Since the polishing pad and substrate rotate during polishing, the x-axis can be parallel with the radius of the polishing pad, perpendicular to the radius of the polishing pad or have any angle between these angles. Typically, however, the x-axis is parallel to and aligned with the radius of the polishing pad. For example, FIGS. 5A and 5B show a circular window 201 having an array of recesses 202 that forms circular or cylindrical projections 203 in a uniform pattern or a symmetrical hexagonal close packed pattern. FIG. 5A bends along axes parallel to its x axis, axes parallel to 60 degrees clockwise from its x axis and axes parallel to 120 degrees clockwise from its x-axis. Since the polishing pad and substrate rotate during polishing, the x-axis can be parallel with the radius of the polishing pad, perpendicular to the radius of the polishing pad or have any angle between these angles. In FIGS. 4A and 4B, the recesses 102 form the lower surface 105 of recesses 102 in the window 101 at a peripheral edge 104 of and throughout the window 101, in that the elements 103 do not extend to the edge 104. In FIGS. 5A and 5B, the recesses 202 extend to a peripheral edge 204 and in regions form the top surface of the peripheral edge while elements 202 also can form a top surface of the window 201 at other regions of the peripheral edge 204.

The pattern can be symmetrical in the x plane going through a center point of the window, the y plane going through a center point of the window or both. The pattern can have point symmetry around a vertical axis through a center point of the window. The uniform windows and particularly the symmetrical windows will provide uniform stiffness reduction and uniform stress relief that facilitate avoidance of undesirable asymmetrical deflection of the window while allowing the material used in the window to have a different modulus from the material used in the polishing portion. While symmetrical patterns are effective, slight offsets from symmetry can also be effective in providing substantially uniform stiffness reduction. In a rectangular shaped window, the recesses can be directed in both the x and y coordinate directions. In a circular or oval or polygonal window, at least some recesses can be directed in multiple radial directions to facilitate bending through a center point and through parallel direction uniformly spaced from the center point.

Figure 6:
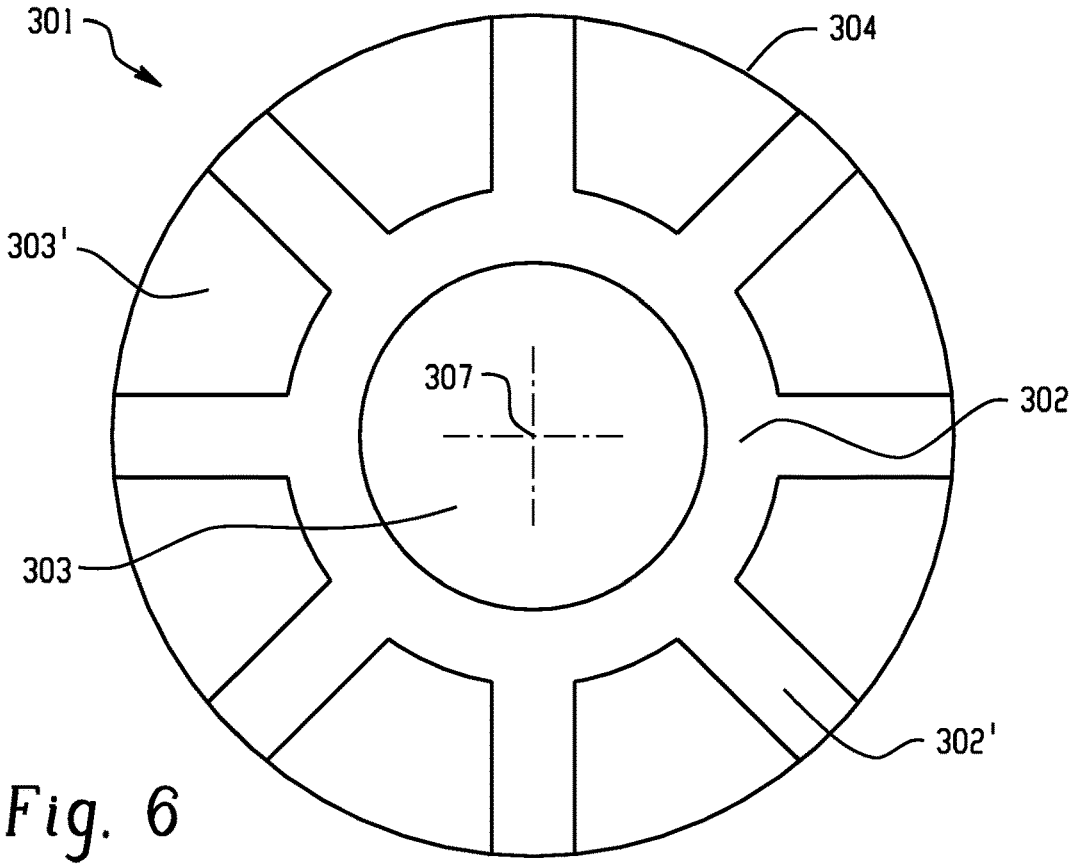
FIG. 6 is a top view of a circular window having a closed curved recess (circular) interconnected with recesses extending toward a periphery of the window.
Figure 7:
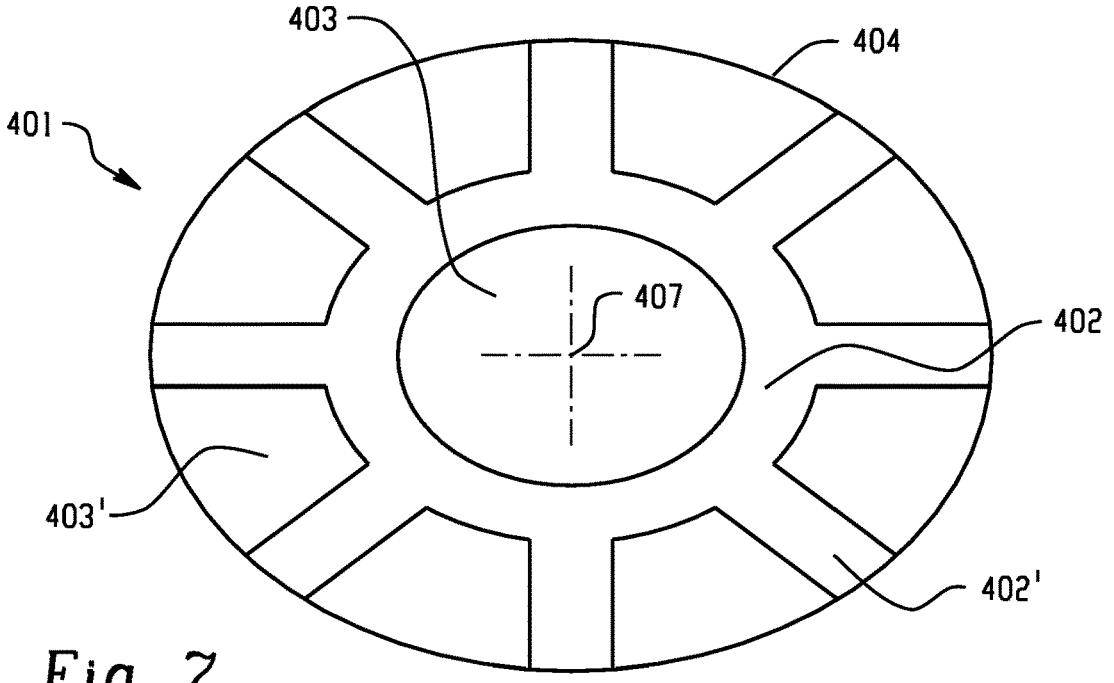
FIG. 7 is a top view of an oval window having a closed curved recess (oval) interconnected with recesses extending toward a periphery of the window.

While FIGS. 4B and 5B, show the elements 103, 203 separated by the recesses 102, 202, respectively with the same size and same spacing over the entire window, alternatively elements of two different sizes or shapes, or recesses of varying width and depth can be used provided that they are placed uniformly across the window. For example, smaller and larger size shapes could be used in alternative patterns—small, large, small, large across the window in the x and y directions with a constant recess dimension or constant element shape and size could be separated by varying recess width or depth provided the variation is uniform across the window in the x and y coordinates. As another example, a first size of elements could be located near the center of the window with a second size of elements uniformly placed around an exterior of a window as shown in one example in FIG. 9. As another example, as shown in FIGS. 6 and 7, a first shape of elements 303 or 403 can be in the center of the window with a second shape and size of elements 303' or 403' located uniformly around the first element 303 or 403 and at or closer to the periphery of the window. Elements 303 or 403 could be single elements or they could be a uniform array of elements separated by recesses.

FIG. 6 shows a circular window 301 having a first recess 302 concentric with the window circumference and defining a central circular projecting (element) 303 and interconnecting additional recesses 302'. Recess 302 with recesses 302' define additional projections (elements 303') as shown having truncated pie shape. The additional recesses are in the radial direction, preferably, at consistent or uniform spacing from each other. In particular, the recesses 302 have a closed curved shape that connects recesses 302' that extend toward a peripheral edge 304 of the transparent window 301. While one concentric recess surrounding circular projecting element 303 is shown, two, three or more multiple concentric surrounding center 307 recesses could be used. This design allows the entire center projecting element to depress into a cavity below the window during polishing. This reduces window contact pressure against a substrate, such as a semiconductor wafer during polishing.

FIG. 7 shows an oval window 401 with an oval recess 402 defining a central oval (projecting element) 403 and interconnecting recesses 402' that project outward toward the periphery of the window 401. The recesses 402 and 402' define additional truncated pie-shaped projections (projecting elements) 403'. In particular, the recesses 402 have a closed curved shape that connects recesses 402' that extend toward a peripheral edge 404 of the transparent window 401. Again, a second or third or more oval recess 402 could be provided. The center projection (projecting element) 303 or 403 can provide a beneficially large area for optics while still providing for reduced stiffness and efficient fluid transport. While one concentric recess surrounding oval projecting element 403 is shown, two, three or more multiple concentric recesses surrounding center 407 could be used. In particular, this design allows the entire oval projecting element to depress into a cavity below the window during polishing. This reduces window contact pressure against a substrate, such as a semiconductor wafer during polishing. The recesses 302' and 402' can extend to a peripheral edge 304 or 404, respectively and form a portion of the respective peripheral edge 304 or 404, while element 303' and 403' can also form a portion of the peripheral edge 304 or 404. The recesses may have no alignment with polishing pad grooves, misalignment with polishing pad grooves or partial alignment with polishing pad grooves.

Figure 8:
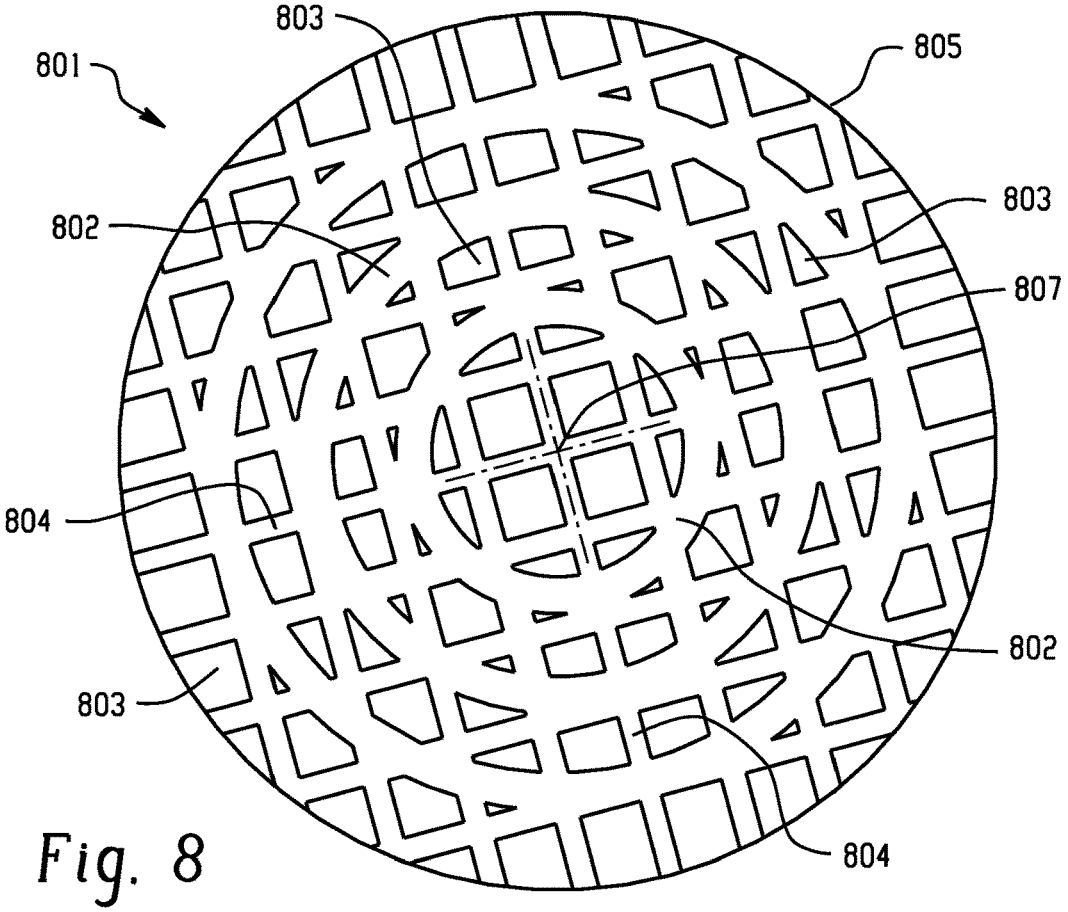
FIG. 8 is a top view of a circular window having concentric recesses interconnected by grid lines.

FIG. 8 shows a window 801 having both concentric circular recesses 802 and grid recesses 804. Together these recesses define elements 803 that have varying shapes that include squares, rectangles and triangles that can be modified with a curved inward or outward edge. Recesses include one or more recessed rings 802 concentric with periphery of circular window 801 and recesses 804 extending linearly across the window 801 in a uniform pattern. Circular recesses 802 allow internal projecting elements to defect inwardly into a recess cavity (not seen). The advantage of the concentric rings is that the force required to depress the window sequentially decreases as one reaches the center of the recess 807. In addition to reduced deflection forces for the projecting elements 803 within the concentric regions, grid recesses 804 allow bending along recesses 804 parallel to the x and y directions. This window shows point symmetry or substantial point symmetry (if the pattern is slightly offset from center). The recesses 804 can extend to a peripheral edge 805 of the window 801. A top surface of peripheral edge 805 can be formed by the recesses 804 and elements 803 located at such peripheral edge 805.

Figure 9:
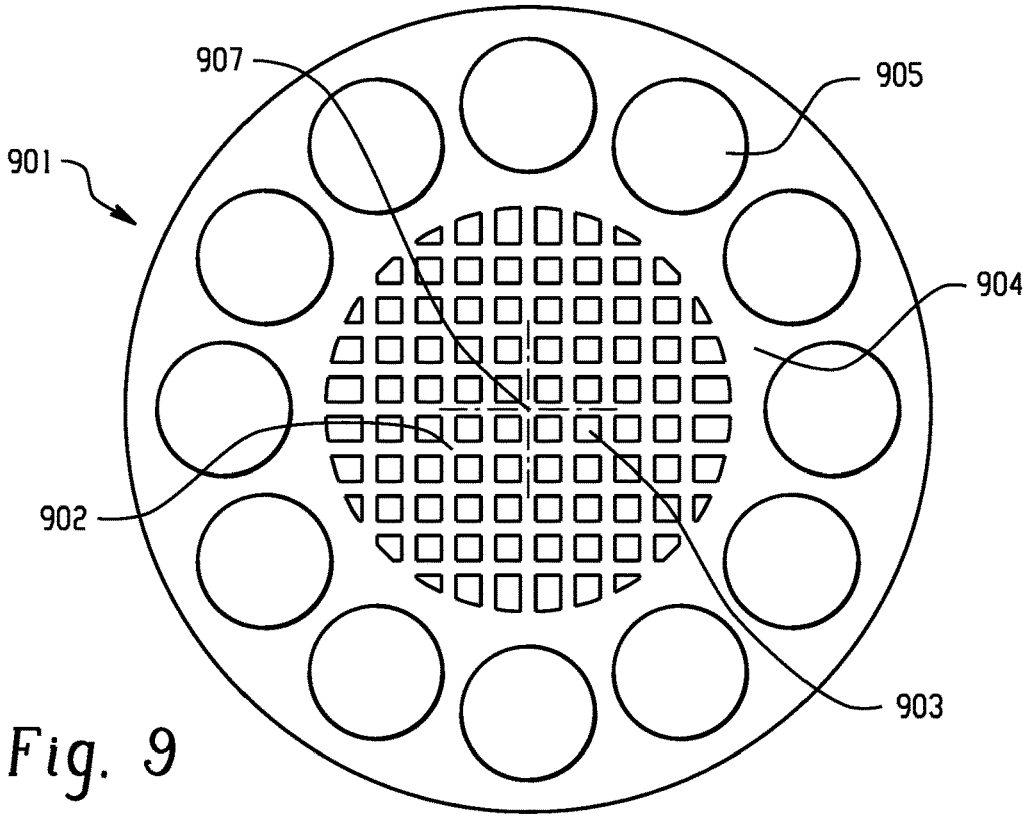
FIG. 9 is a top view of a circular window having a uniform pattern including small elements of substantially uniform dimensions separated by small recesses surrounded by larger elements and recesses around a periphery of the window.

FIG. 9 shows a window 901 having an interior portion with small elements 903 and recesses 902 and having larger element 905 and larger recesses 904 around a periphery of the window. This pattern includes a first group of elements 903 separated by a first group of recesses 902 wherein the first group of elements 903 and the first set of recesses 902 are surrounded by a second group of elements 905 and a second set of recesses 904 wherein the elements 905 of the second group are larger than the elements 903 of the first group and the recesses 904 of the second set are larger than the recesses 902 of the first set 902. This window shows point symmetry, or if it were slightly offset from center would should substantial point symmetry. The recesses 904 can form a peripheral edge of the window 901. The recesses 904 allow internal projecting elements 903 to deflect inwardly into a recess cavity (not seen). In addition to reduced deflection forces for the central projecting elements 903 is that the grid recesses 902 allow bending parallel to the x and y directions. The recesses 902 and 904 combine to decrease bending force to a minimum at center 907.

The size of the polishing pad can be at least 10, at least 20, at least 30, at least 40, or at least 50 centimeters (cm) up to 100, up to 90, or up to 80 cm. The pad can be provided in any shape, but it can be convenient to have a circular or disc shape with a diameter in the ranges as stated above. The window can have dimensions of at least 0.5 or at least 1 cm up to 3, or up to 2.5, up to 2, or up to 1 cm (in length and width (or in diameter if a circular window).

The polishing pad can have a total thickness of at least 1 mm up to 4 or up to 3 mm. The thickness of the window can be less that the total thickness of the pad. If the pad includes a top polishing portion on a sub pad, the thickness of the window can be more than the thickness of the top polishing portion (but should not be more than the total thickness of the pad (e.g. thickness of top pad plus thickness of sub pad). The thickness of the polishing portion can be at least 1, or at least 1.1 mm up to 3, or up to 2.5 mm. The thickness of the window can be at least 0.5, at least 0.75, or at least 1 mm, up to 3, up to 2.9, up to 2.5 mm. The depth of the recesses can be at least 10% up to 60% or up to 50% the thickness of the window. The depth of the recesses can be at least 0.2 or at least 0.3 mm up to 2 or up to 1.5 mm. The width of the recesses can be at least 0.3, at least 0.5, or at least 0.8 mm up to 10, up to 5, up to 3, up to 2, or up to 1.5 mm. The recess with can be up to 30%, up to 20% or up to 10% of the maximum dimension of the window. The elements separated by the recesses can have a dimension (e.g. length, width, radius) of at least 0.3 or at least 0.5 or at least 0.8 mm up to 10, up to 8, up to 6, up to 5, up to 4, up to 3, or up to 2 mm. There can be at least 4, at least 5, at least 6, at least 7, at least 8, at least 9 or at least 10 elements up to 200, up to 150, up to 100, up to 50, up to 40, or up to 30 elements separated by recesses in the window.

As shown in FIGS. 3A and 3B, the polishing portion 15 can have grooves 12. Concentric grooves are shown but other groove patterns can be used, such as radial grooves or cross-hatch grooves. Alternatively, the polishing portion of the pad may have other texture. The polishing portion of the pad can be porous or be formed from lattices of materials or have other patterns thereon. The recesses of the window can align with the grooves in the polishing portion. Alternatively, the recesses of the window can be positioned such that they are not aligned or partially aligned with grooves in the polishing portion. Typically, most of the recesses do not align with grooves in the polishing layer.

The window can comprise a variety of flexible materials provided they are transparent to the signal used in endpoint detection. For example, the window can comprise thermoplastic and thermoset polymers. Examples of such thermoplastic polymers include polyurethane, polyolefin, polystyrene, polysulfone, polyacrylate, polycarbonate, fluorinated polymers, and polyacetal. Examples of such thermoset polymers include polyurethane, phenolic, polyester, epoxy, and silicone. Selection of a particular window polymer depends on achieving an adequate match of conditioning wear rate relative to the top pad layer and the level of light transmission that can be achieved in the final pad relative to the functional requirements of the particular optical endpointing device being used (i.e., it is suitable for optical measurements). It should be appreciated that the design of the windows of the present invention provides a great deal of flexibility relative to prior art designs. The window can have a transmission to electromagnetic radiation in the wavelengths of at least 190, at least 200, or at least 22 up to 1200, up to 850 or up to 650 nm. The material of the window can have a Young's modulus according to ASTMD412-16 of at least 4, at least 10, or at least 100 MPa, or at least 0.2, at least 0.3, at least 0.4, at least 0.5, at least 0.7, or at least 1 GPa up to 10, or up to 5, up to 2 GPa.

The windows disclosed herein can be produced using a wide variety of materials and techniques. Some exemplary techniques include machining of the upper window surface to produce the desired pattern of interconnected recesses. Alternatively, the window may be cast into a mold containing the reverse pattern of the desired array of recesses to produce a final net shape window. For thermoplastic polymers, the net shape window may also be fabricated via hot pressing, injection molding, and others. The window can be made by additive manufacturing.

The polishing portion can comprise any composition commonly used in polishing pads. The polishing portion can comprise thermoplastic or thermoset polymers. The polishing portion can be a composite such as composites include polymers filled with carbon or inorganic fillers and fibrous mats of, for example glass or carbon fibers, impregnated with a polymer. The polishing portion can have voids. Examples of polymers that can be used in the polishing portion in polymeric materials that can be used in the base pad or polishing portion include polycarbonates, polysulfones, nylons, epoxy resins, polyethers, polyesters, polystyrenes, acrylic polymers, polymethyl methacrylates, polyvinylchlorides, polyvinyl fluorides, polyethylenes, polypropylenes, polybutadienes, polyethylene imines, polyurethanes, polyether sulfones, polyamides, polyether imides, polyketones, epoxies, silicones, copolymers thereof (such as, polyether-polyester copolymers), and combinations or blends thereof. The polymer can be a polyurethane.

The polishing portion can have Young's modulus of according to ASTM D412-16 of at least 2, at least 2.5, at least 5, at least 10, or at least 50 MPa up to 900, up to 700, up to 600, up to 500, up to 400, up to 300, or up to 200 MPa. The polishing portion can be opaque to the signal being used for endpoint detection.

A base pad (also referred to as sublayer or base layer) can be used under the polishing portion. The base pad can be a single layer or can comprise more than one layer. The use of a base pad provides a cavity for allowing bending of the window by removing the base pad or subpad underneath the window. The top surface of the base pad can define a plane, in the x-y Cartesian coordinates. For example, the polishing portion may be attached to a subpad via mechanical fasteners or by an adhesive. The base layer can have a thickness of at least 0.5 or at least 1 mm. The base layer can have a thickness of no more than 5, no more than 3, or no more than 2 mm.

The base pad or base layer may comprise any material known for use as base layers for polishing pads. For example, it can comprise a polymer, a composite of a polymeric material with other materials, ceramic, glass, metal, stone or wood. Polymers and polymer composites can be used as the base pad, particularly for the top layer if there is more than one layer, due to compatibility with the material that can form the polishing portion. Examples of such composites include polymers filled with carbon or inorganic fillers and fibrous mats of, for example glass or carbon fibers, impregnated with a polymer. The base of the pad can be made of a material having one or more of the following properties: a Young's modulus as determined, for example, by ASTMD412-16 in the range of at least 2, at least 2.5, at least 5, at least 10, or at least 50 MPa up to 900, up to 700, up to 600, up to 500, up to 400, up to 300, or up to 200 MPa; a Poisson's ratio as determined, for example, by ASTM E132015 of at least 0.05, at least 0.08, or at least 0.1 up to 0.6 or up to 0.5; a density of at least 0.4 or at least 0.5 up to 1.7, up to 1.5, or up to 1.3 grams per cubic centimeter ($g/cm^3$).

Examples of such polymeric materials that can be used in the base pad or polishing portion include polycarbonates, polysulfones, nylons, epoxy resins, polyethers, polyesters, polystyrenes, acrylic polymers, polymethyl methacrylates, polyvinylchlorides, polyvinyl fluorides, polyethylenes, polypropylenes, polybutadienes, polyethylene imines, polyurethanes, polyether sulfones, polyamides, polyether imides, polyketones, epoxies, silicones, copolymers thereof (such as, polyether-polyester copolymers), and combinations or blends thereof.

The polymer can be a polyurethane. The polyurethane can be used alone or can be a matrix for carbon or inorganic fillers and fibrous mats of, for example glass or carbon fibers.

For purposes of this specification, "polyurethanes" are products derived from difunctional or polyfunctional isocyanates, e.g. polyetherureas, polyisocyanurates, polyurethanes, polyureas, polyurethaneureas, copolymers thereof and mixtures thereof. The CMP polishing pads in accordance may be made by methods comprising: providing the isocyanate terminated urethane prepolymer; providing separately the curative component; and combining the isocyanate terminated urethane prepolymer and the curative component to form a combination, then allowing the combination to react to form a product. It is possible to form the base pad or base layer by skiving a cast polyurethane cake to a desired thickness. Optionally, preheating a cake mold with IR radiation, induction or direct electrical current can reduce product variability when casting porous polyurethane matrices. Optionally, it is possible to use either thermoplastic or thermoset polymers. The polymer can be a crosslinked thermoset polymer.

When a polyurethane is used in the base pad or the polishing layer it can be the reaction product of a polyfunctional isocayante and a polyol. For example, a polyisocyante terminated urethane prepolymer can be used. The polyfunctional isocyanate used in the formation of the polishing layer of the chemical mechanical polishing pad of the present invention can be selected from the group consisting of an aliphatic polyfunctional isocyanate, an aromatic polyfunctional isocyanate and a mixture thereof. For example, the polyfunctional isocyanate used in the formation of the polishing layer of the chemical mechanical polishing pad of the present invention can be a diisocyanate selected from the group consisting of 2,4-toluene diisocyanate; 2,6-toluene diisocyanate; 4,4'-diphenylmethane diisocyanate; naphthalene-1,5-diisocyanate; tolidine diisocyanate; para-phenylene diisocyanate; xylylene diisocyanate; isophorone diisocyanate; hexamethylene diisocyanate; 4,4'-dicyclohexylmethane diisocyanate; cyclohexanediisocyanate; and, mixtures thereof. The polyfunctional isocyanate can be an isocyanate terminated urethane prepolymer formed by the reaction of a diisocyanate with a prepolymer polyol. The isocyanate-terminated urethane prepolymer can have 2 to 12 wt %, 2 to 10 wt %, 4 to 8 wt % or 5 to 7 wt % unreacted isocyanate (NCO) groups. The prepolymer polyol used to form the polyfunctional isocyanate terminated urethane prepolymer can be selected from the group consisting of diols, polyols, polyol diols, copolymers thereof and mixtures thereof. For example, the prepolymer polyol can be selected from the group consisting of polyether polyols (e.g., poly(oxytetramethylene)glycol, poly(oxypropylene)glycol and mixtures thereof); polycarbonate polyols; polyester polyols; polycaprolactone polyols; mixtures thereof; and, mixtures thereof with one or more low molecular weight polyols selected from the group consisting of ethylene glycol; 1,2-propylene glycol; 1,3-propylene glycol; 1,2-butanediol; 1,3-butanediol; 2-methyl-1,3-propanediol; 1,4-butanediol; neopentyl glycol; 1,5-pentanediol; 3-methyl-1,5-pentanediol; 1,6-hexanediol; diethylene glycol; dipropylene glycol; and, tripropylene glycol. For example, the prepolymer polyol can be selected from the group consisting of polytetramethylene ether glycol (PTMEG); ester-based polyols (such as ethylene adipates, butylene adipates); polypropylene ether glycols (PPG); polycaprolactone polyols; copolymers thereof; and, mixtures thereof. For example, the prepolymer polyol can be selected from the group consisting of PTMEG and PPG. When the prepolymer polyol is PTMEG, the isocyanate terminated urethane prepolymer can have an unreacted isocyanate (NCO) concentration of 2 to 10 wt % (more preferably of 4 to 8 wt %; most preferably 6 to 7 wt %). Examples of commercially available PTMEG based isocyanate terminated urethane prepolymers include Imuthane® prepolymers (available from COIM USA, Inc., such as, PET-80A, PET-85A, PET-90A, PET-93A, PET-95A, PET-60D, PET-70D, PET-75D); Adiprene® prepolymers (available from Chemtura, such as, LF 800A, LF 900A, LF 910A, LF 930A, LF 931A, LF 939A, LF 950A, LF 952A, LF 600D, LF 601D, LF 650D, LF 667, LF 700D, LF750D, LF751D, LF752D, LF753D and L325); Andur® prepolymers (available from Anderson Development Company, such as, 70APLF, 80APLF, 85APLF, 90APLF, 95APLF, 60DPLF, 70APLF, 75APLF). When the prepolymer polyol is PPG, the isocyanate terminated urethane prepolymer can have an unreacted isocyanate (NCO) concentration of 3 to 9 wt % (more preferably 4 to 8 wt %, most preferably 5 to 6 wt %). Examples of commercially available PPG based isocyanate terminated urethane prepolymers include Imuthane® prepolymers (available from COIM USA, Inc., such as, PPT-80A, PPT-90A, PPT-95A, PPT-65D, PPT-75D); Adiprene® prepolymers (available from Chemtura, such as, LFG 963A, LFG 964A, LFG 740D); and, Andur® prepolymers (available from Anderson Development Company, such as, 8000APLF, 9500APLF, 6500DPLF, 7501DPLF). The isocyanate terminated urethane prepolymer can be a low free isocyanate terminated urethane prepolymer having less than 0.1 wt % free toluene diisocyanate (TDI) monomer content. Non-TDI based isocyanate terminated urethane prepolymers can also be used. For example, isocyanate terminated urethane prepolymers include those formed by the reaction of 4,4'-diphenylmethane diisocyanate (MDI) and polyols such as polytetramethylene glycol (PTMEG) with optional diols such as 1,4-butanediol (BDO) are acceptable. When such isocyanate terminated urethane prepolymers are used, the unreacted isocyanate (NCO) concentration is preferably 4 to 10 wt % (more preferably 4 to 10 wt %, most preferably 5 to 10 wt %). Examples of commercially available isocyanate terminated urethane prepolymers in this category include Imuthane® prepolymers (available from COIM USA, Inc. such as 27-85A, 27-90A, 27-95A); Andur® prepolymers (available from Anderson Development Company, such as, IE75AP, IE80AP, IE85AP, IE90AP, IE95AP, IE98AP); and, Vibrathane® prepolymers (available from Chemtura, such as, B625, B635, B821).

Production of the final pad containing the windows as disclosed herein can be prepared via a number of techniques including, but not limited to, preparation of a discrete window having the desired pattern of recesses in the upper window surface, followed by insertion into an opening in the upper pad layer that is aligned with the aperture in the sub-pad layer (a so-called insertion window). A sealant or adhesive can be used to secure the window in the polishing pad. Examples of such materials include pressure sensitive adhesives, acrylics, polyurethanes, and cyanoacrylates. Alternatively, a block of the window material can be machined to the cross-sectional dimensions of the final window. This block is placed in a mold and the top pad layer material is cast around it. The resulting composite cylinder can then be sliced into sheets of a desired thickness, after which the texture of the upper window surface is produced. As another alternative, the pad with window can be formed by casting the polishing portion around the finished window via techniques such as injection molding or compression molding to produce a single net shaped top pad layer, with the composite window cast in place.

Method

The polishing pads as disclosed here can be used to polish substrates. For example, the polishing method can include providing a substrate to be polished and then polishing using the pad disclosed herein with the protrusions in contact with the substrate to be polished. The substrate can be any substrate where polishing and/or planarization is desired. Examples of such substrates include magnetic, optical and semiconductor substrates. The method made be part front end of line or back end of line processing for integrated circuits. For example, the process can be used to remove undesired surface topography and surface defects, such as rough surfaces, agglomerated materials, crystal lattice damage, scratches and contaminated layers or materials. In addition, in damascene processes a material is deposited to fill recessed areas created by one or more steps of photolithography, patterned etching, and metallization. Certain steps can be imprecise—e.g. there can be overfilling of recesses. The method disclosed here can be used to remove material outside the recesses. The process can be chemical mechanical planarization or chemical mechanical polishing both of which can be referred to as CMP. A carrier can hold the substrate to be polished—e.g. a semiconductor wafer (with or without layers formed by lithography and metallization) in contact with the polishing elements of the polishing pad. A slurry or other polishing medium can be dispensed into a gap between the substrate and the polishing pad. The polishing pad and substrate are moved relative to one another—e.g. rotated. The polishing pad is typically located below the substrate to be polished. The polishing pad can rotate. The substrate to be polished can also be moved—e.g. on a polishing track such as an annular shape. The relative movement causes the polishing pad to approach and contact the surface of the substrate.

For example, the method can comprise: providing a chemical mechanical polishing apparatus having a platen or carrier assembly; providing at least one substrate to be polished; providing a chemical mechanical polishing pad as disclosed herein; installing onto the platen the chemical mechanical polishing pad; optionally, providing a polishing medium (e.g. slurry and/or non-abrasive containing reactive liquid composition) at an interface between a polishing portion of the chemical mechanical polishing pad and the substrate; creating dynamic contact between the polishing portion of the polishing pad and the substrate, wherein at least some material is removed from the substrate. The carrier assembly carrier assembly can provide a controllable pressure between the substrate being polished (e.g. wafer) and the polishing pad. The polishing medium a polishing medium can be dispensed onto the polishing pad and drawn into the gap between the wafer and polishing layer. The polishing medium can comprise water, a pH adjusting agent, and optionally one or more of, but not limited to, the following: an abrasive particle, an oxidizing agent, an inhibitor, a biocide, soluble polymers, and salts. The abrasive particle can be an oxide, metal, ceramic, or other suitably hard material. Typical abrasive particles are colloidal silica, fumed silica, ceria, and alumina. The polishing pad and substrate can rotate relative to one another. As the polishing pad rotates beneath the substrate, the substrate can sweep out a typically annular polishing track, or polishing region, wherein the wafer's surface directly confronts the polishing portion of the polishing pad. The wafer surface is polished and made planar by chemical and mechanical action of the polishing layer and polishing medium on the surface. Optionally, the polishing surface of the polishing pad can be conditioned with an abrasive conditioner before beginning polishing. The method of the present invention, the chemical mechanical polishing apparatus provided further includes a signal source (e.g. a light source) and a signal detector (e.g. a photosensor (preferably a multisensor spectrograph). The method can therefore comprise: determining a polishing endpoint by transmitting a signal (e.g. light from the light source) through the window and analyzing the signal (e.g. light) reflected off the surface of the substrate back through the endpoint detection window incident upon the sensor (e.g. photosensor). The substrate can have a metal or metallized surface, such as one containing copper or tungsten. The substrate can be a magnetic substrate, an optical substrate and a semiconductor substrate.

Example 1

A polishing pad was prepared that incorporates a window of the design illustrated in Drawing 5. The window (301) was circular, with a diameter of 18 mm and a thickness of 2.032 mm. These dimensions are equivalent to those found in prior art window pads. Samples were made from several materials capable of transmitting UV/visible light in the wavelength range of 250-800 nm.

The recess design consists of a central raised region or element (303) of 6 mm in diameter that has no recesses, and an outer region of eight polygonal raised areas or elements (303'). The surface of all raised elements was coplanar with the polishing pad top surface, and the bottom of the window (301) is coplanar with the interface between the polishing portion (i.e. polishing layer) and lower layers (i.e. sublayer or base layer) of the polishing pad. Between central and polygon regions, there is a circular recessed area (302) of 1.524 mm width and 0.762 mm depth. Each polygon raised area (303') was separated by eight recessed areas (302') having the same width and depth as the circular recessed area (302) that intersects with the circular recessed area (302) to provide a continuous recess pattern that is capable of supporting slurry transport.

Complete samples were tested on an Applied Materials Reflexion™ LK CMP apparatus that incorporated an optical endpoint detector of their proprietary design. The optical signal strength of the exemplary pads was found to be within the normal range for commercial use. This Example disproves the expectation that multiple recesses in the window would render the light signal, weak, irregular and unacceptable for wafer endpoint detection.

Comparative Example

Figure 10A:
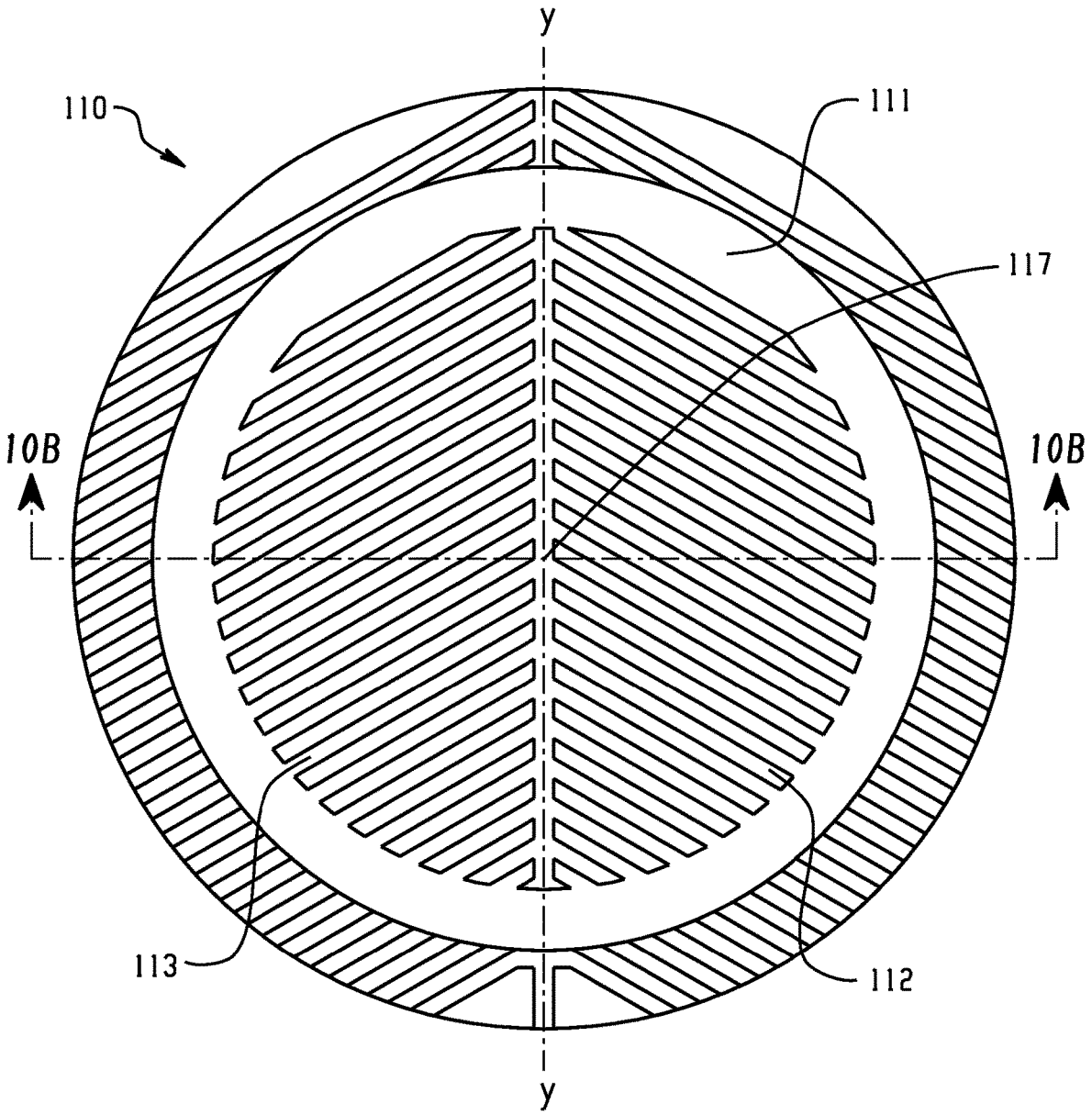
FIG. 10A is a comparative window design with a pattern that is not uniform.
Figure 10B:
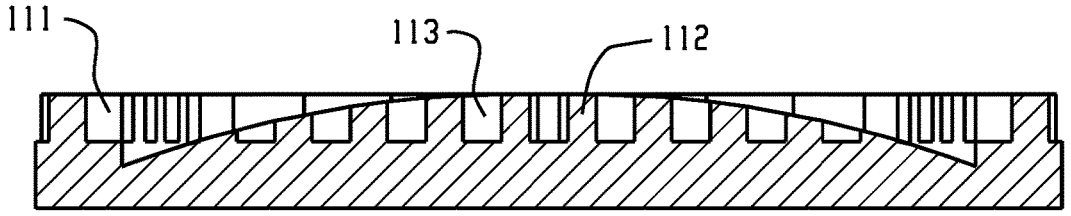
FIG. 10B is a cross section of the pad of 10A, taken along plane 10B-10B.

A pad was made including a circular window as shown in FIGS. 10A and 10B. This window 110 had a concentric groove 111 and features 112 of varying heights separated by grooves 113 in a v-shape. This pad is not uniform in that the pattern is not consistent in the x and y directions and it lacks point symmetry or substantial point symmetry about center 117. Furthermore, the center projecting elements have a width greater than half the width or diameter of window 110. This renders slurry flow around features 112 tortuous with dead ends that would collect slurry. Both the tortuous flow of slurry and collection of slurry lead to undesirable polishing defects. Attempts to polish with use of a sensor for detection through the window show unacceptably high signal to noise ratio such that the sensor is not effective. In addition, compliance of this window would not be uniform in the x and y directions such that the window may deflect more in one of those directions than the other.

This disclosure further encompasses the following aspects.

Aspect 1: A polishing pad useful in chemical mechanical polishing of a semiconductor, optical or magnetic substrate comprising a polishing portion having a top polishing surface, a bottom layer for mounting to a platen and a polishing material, the top polishing surface including grooves; an opening through the polishing pad, and a transparent window within the opening in the polishing pad, the transparent window being flexible and having a thickness measured from a bottom of the transparent window to the top polishing surface of the transparent window and being secured to the polishing pad with the transparent window spaced from the platen to form a cavity and being transparent to at least one of magnetic and optical signals, the transparent window having a plurality of projecting elements at a perimeter of the transparent window and filling the center of the transparent window, the tops of the plurality of projecting elements representing the top polishing surface of the transparent window, the projecting elements having an initial height of at least thirty percent of the thickness of the transparent window, the projecting elements being coplanar with the top polishing surface separated by interconnected recesses that extend to a peripheral edge of the transparent window to provide a projecting element pattern in the top surface wherein a majority of the recesses have partial or complete misalignment with the grooves in the top polishing surface and the projecting element pattern allows bending about multiple axes with the transparent window bending into the cavity and at least two of the axes are non-parallel or with a center projecting element, the center projecting element surrounded by one or more recesses that bend downward into the cavity with the center projecting element having a width less than half a longest dimension of the transparent window for reducing contact pressure with the substrate during polishing.

Aspect 2: The polishing pad of Aspect 1 wherein the transparent window has a center and the projecting elements and recesses have point symmetry about the center.

Aspect 3: The polishing pad of Aspect 1 or 2 wherein the recesses create a cross-hatch pattern.

Aspect 4: The polishing pad of any of the preceding Aspects wherein the projecting elements have a cylindrical shape.

Aspect 5: The polishing pad of any of the preceding Aspects wherein recesses include a closed curved shape connecting recesses extending toward a peripheral edge of the transparent window.

Aspect 6: The polishing pad of any of the preceding Aspects wherein the pattern includes hexagonal close packed projecting elements.

Aspect 7: The polishing pad of any of the preceding Aspects wherein the pattern includes a first group of elements separated by a first group of recesses wherein the first group of elements and the first set of recesses are surrounded by a second group of elements and a second set of recesses wherein the elements of the second group are larger than the elements of the first group and the recesses of the second set are larger than the recesses of the first set.

Aspect 8: The polishing pad of any of the preceding Aspects wherein recesses include one or more recessed rings concentric with periphery of circular window and recesses extending linearly across the window in a uniform pattern.

Aspect 9: The polishing pad of any of the preceding Aspects wherein the pattern has point symmetry about its x and y axes.

Aspect 10: The polishing pad of any of the preceding aspects wherein the depth of the recess is 30 to 60, preferably 35 to 55, percent of a thickness of the window.

Aspect 11: The polishing pad of any of the preceding aspects wherein there are from 4 to 200 elements, preferably 10 to 100 elements.

Aspect 12: The polishing pad of any of the preceding aspects wherein there are at least 4 to 100 recesses, preferably 10 to 50 recesses.

Aspect 13: The polishing pad of any of the preceding aspects wherein the recesses are in the form of grooves.

Aspect 14: The polishing pad of any of the preceding aspects wherein the polishing portions comprises a series of cylindrical pillars.

Aspect 15: The polishing pad of aspect 14 wherein the grooves in the polishing pad are aligned to the recesses.

Aspect 16: The polishing pad of aspect 14 wherein the grooves are not aligned to the recesses.

Aspect 17: The polishing pad of any of the preceding aspects wherein compliance of the window to stress is consistent along parallel axes in the x and y directions.

Aspect 19: The polishing pad of any of the preceding aspects wherein the recesses have a width of 0.3 to 10 mm, preferably 0.5 to 3 mm.

Aspect 20: The polishing pad of any of the preceding aspects wherein the elements have a dimension of 0.3 to 10 mm, preferably 0.5 to 5 mm, more preferably 0.8 to 3 mm.

Aspect 21: A method of polishing comprising providing a substrate, polishing the substrate using the polishing pad of any of the preceding aspects, and providing an optical or magnetic signal, preferably an optical signal, through the transparent window and detecting a response to the signal and monitoring the response to determine when polishing is complete.

Aspect 22: The method of aspect 21 wherein polishing medium, preferably slurry, and material removed during polishing, are moved from the substrate through the recesses.

The compositions, methods, and articles can alternatively comprise, consist of, or consist essentially of, any appropriate materials, steps, or components herein disclosed. The compositions, methods, and articles can additionally, or alternatively, be formulated to be devoid, or substantially free, of any materials (or species), steps, or components, that are otherwise not necessary to the achievement of the function or objectives of the compositions, methods, and articles.

All ranges disclosed herein are inclusive of the endpoints, and the endpoints are independently combinable with each other (e.g., ranges of "up to 25 wt. %, or, more specifically, 5 wt. % to 20 wt. %", is inclusive of the endpoints and all intermediate values of the ranges of "5 wt. % to 25 wt. %," etc.). Moreover, stated upper and lower limits can be combined to form ranges (e.g. "at least 1 or at least 2 weight percent" and "up to 10 or 5 weight percent" can be combined as the ranges "1 to 10 weight percent", or "1 to 5 weight percent" or "2 to 10 weight percent" or "2 to 5 weight percent"). "Combinations" is inclusive of blends, mixtures, alloys, reaction products, and the like. The terms "first," "second," and the like, do not denote any order, quantity, or importance, but rather are used to distinguish one element from another. The terms "a" and "an" and "the" do not denote a limitation of quantity and are to be construed to cover both the singular and the plural, unless otherwise indicated herein or clearly contradicted by context. "Or" means "and/or" unless clearly stated otherwise. Reference throughout the specification to "some embodiments", "an embodiment", and so forth, means that an element described in connection with the embodiment is included in at least one embodiment described herein, and may or may not be present in other embodiments. In addition, it is to be understood that the described elements may be combined in any suitable manner in the various embodiments. A "combination thereof" is open and includes any combination comprising at least one of the listed components or properties optionally together with a like or equivalent component or property not listed.

Unless specified to the contrary herein, all test standards are the most recent standard in effect as of the filing date of this application, or, if priority is claimed, the filing date of the earliest priority application in which the test standard appears.

What is claimed is:

1. A polishing pad useful in chemical mechanical polishing of a semiconductor, optical or magnetic substrate comprising a polishing portion having a top polishing surface, a bottom layer for mounting to a platen and a polishing material, the top polishing surface including grooves;

an opening through the polishing pad, and a transparent window within the opening in the polishing pad, the transparent window being flexible and having a thickness measured from a bottom of the transparent window to the top polishing surface of the transparent window and being secured to the polishing pad with the transparent window spaced from the platen to form a cavity and being transparent to at least one of magnetic and optical signals, the transparent window having a plurality of projecting elements at a perimeter of the transparent window and a plurality of projecting elements filling the center of the transparent window, the tops of the plurality of projecting elements representing the top polishing surface of the transparent window, the projecting elements having an initial height of at least thirty percent of the thickness of the transparent window, the projecting elements being coplanar with the top polishing surface separated by interconnected recesses that extend to a peripheral edge of the transparent window to provide a projecting element pattern in the top surface wherein a majority of the recesses have partial or complete misalignment with the grooves in the top polishing surface and the projecting element pattern allows bending about multiple axes with the transparent window bending into the cavity and at least two of the multiple axes are non-parallel, or the projecting element is a center projecting element, the center projecting element surrounded by one or more recesses that bend downward into the cavity with the center projecting element having a width less than half a longest dimension of the transparent window for reducing contact pressure with the substrate during polishing.

2. The polishing pad of claim 1 wherein the transparent window has a center and the projecting elements and recesses have point symmetry about the center.

3. The polishing pad of claim 1 wherein the recesses create a cross-hatch pattern.

4. The polishing pad of claim 1 wherein the projecting elements have a cylindrical shape.

5. The polishing pad of claim 1 wherein recesses include a closed curved shape connecting recesses extending toward a peripheral edge of the transparent window.

6. The polishing pad of claim 1 wherein the pattern includes hexagonal close packed projecting elements.

7. The polishing pad of claim 1 wherein the pattern includes a first group of elements separated by a first group of recesses wherein the first group of elements and the first set of recesses are surrounded by a second group of elements and a second set of recesses wherein the elements of the second group are larger than the elements of the first group and the recesses of the second set are larger than the recesses of the first set.

8. The polishing pad of claim 1 wherein recesses include one or more recessed rings concentric with periphery of circular window and recesses extending linearly across the window in a uniform pattern.

9. The polishing pad of claim 1 wherein the pattern has point symmetry about its x and y axes.

* * * * *